US007372369B2

(12) United States Patent
Larkin

(10) Patent No.: US 7,372,369 B2
(45) Date of Patent: May 13, 2008

(54) MONITORING OF ALARM SYSTEM WIRING

(75) Inventor: Gary N. Larkin, Henfield (GB)

(73) Assignee: Honeywell International, Inc., Morristown, NJ (US)

( * ) Notice: Subject to any disclaimer, the term of this patent is extended or adjusted under 35 U.S.C. 154(b) by 182 days.

(21) Appl. No.: 11/262,391

(22) Filed: Oct. 28, 2005

(65) Prior Publication Data

US 2007/0085694 A1 Apr. 19, 2007

(30) Foreign Application Priority Data

Oct. 19, 2005 (EP) ..... 05256469

(51) Int. Cl.
*G08B 21/00* (2006.01)

(52) U.S. Cl. ..... 340/652; 340/635; 340/651; 324/525

(58) Field of Classification Search ..... None
See application file for complete search history.

(56) References Cited

U.S. PATENT DOCUMENTS 3,351,934 A * 11/1967 Vietz ..... 340/513
3,500,394 A 3/1970 Egesdal ..... 307/317 R
3,665,461 A * 5/1972 Gnagi et al. ..... 340/509
3,797,008 A * 3/1974 Yuasa ..... 340/511
4,037,220 A * 7/1977 Beyersdorf ..... 340/652
4,191,946 A 3/1980 Gonzalez et al. ..... 340/506
4,224,538 A 9/1980 Cholin et al. ..... 327/493
4,464,621 A * 8/1984 Prigent et al. ..... 324/522
5,049,855 A * 9/1991 Slemon et al. ..... 340/550
5,159,319 A * 10/1992 Dunk et al. ..... 340/546
6,163,263 A * 12/2000 Tice et al. ..... 340/635

OTHER PUBLICATIONS

Communication, European Patent Office, "European Search Report", Mar. 28, 2006—Munich, 3 pages.

* cited by examiner

*Primary Examiner*—Benjamin C. Lee
*Assistant Examiner*—Son Tang
(74) *Attorney, Agent, or Firm*—Welsh & Katz, Ltd.

(57) ABSTRACT

A supervisory method and apparatus provide for detection of "partial fault" conditions such as a relatively high series impedance in the wiring, or a relatively low parallel impedance across the wiring. A non-linear element, such as a semiconductor diode, can be used as an end of line element. The element functions as a current controlled dynamic impedance such that currents through the element can be used to detect low parallel leakage currents. Higher currents through the element can be used to detect partial open circuits.

14 Claims, 5 Drawing Sheets

MONITORING OF ALARM SYSTEM WIRING

FIELD OF THE INVENTION

The invention pertains to ambient condition monitoring systems. More particularly, the invention pertains to such systems which incorporate additional supervisory circuitry to be able to monitor system wiring for open or short circuit faults.

BACKGROUND OF THE INVENTION

Many known alarm systems incorporate wired circuits for purposes of communicating with and/or providing electrical energy to various types of detectors and/or output devices such as sounders, strobe lights and the like all without limitation. The nature of such systems is such that a supervisory function is often provided for such wiring. Such are often monitored to determine if they are exhibiting either gross open circuit or short circuit conditions.

One prior art solution has been to terminate the spur wiring with an end of line resistor. The value of the resistor is such that it will not affect operation of output appliances such as sounders or strobe lights or the like when the spur has been energized in response to a detected alarm condition. In the absence of an alarm condition, the polarity on the spur can be reversed by the local control unit and a monitoring current provided which can be expected to flow only through the end of line resistor under normal operating circumstances.

A gross open circuit can be readily detected since the monitoring current cannot flow through the output appliances in a reverse polarity condition. Similarly, a gross short circuit can be detected as the supervisory current will exceed a normal expected value.

FIG. 1 illustrates a prior art alarm system 10 which incorporates a system control unit 12. Unit 12 is in communication with a plurality of detectors 14 via a wired medium 16. As is conventional, the detectors 14 can communicate their status relative to one or more sensed ambient conditions to the control unit 12 for evaluation.

Control unit 12 can also incorporate a switchable power supply 20 which is coupled to a wired output medium 22. A plurality of output devices 26 can be coupled across the output medium 22. The output medium 22 terminates in an end of line resister 30.

In normal operation, a non-alarm state, the system 10 via the switchable power supply 20 can couple a supervisory current Isup through end of line resister 30 with a polarity as indicated relative to resister 30. With the indicated polarity, the output devices or appliances 26 which could be strobe lights, horns, sirens, bells, sounders all without limitation are inactive and non responsive. Both the presence of a gross short across the wired medium 26 or an open circuit therein can be detected by the value of the supervisory current.

In the event of an alarm condition the power supply 20 reverses polarity and energizes the output appliances 26 via a drive current Id as indicated. In this condition the loop, medium 26, is not being supervised.

However, end of line resistors, and supervisory currents, as described above, while useful may not detect all such faults. For example, a high series impedance, not an open circuit, in the spur or a low parallel impedance, not a short circuit, across the spur may not be detectable using known resistor end of line techniques. In such circumstances, while the system may appear to be fault free, it may not be able to activate all of the output devices when required.

Thus there is a continuing need for supervisory circuits and methods which can detect partial fault conditions of the type described above. Preferably such circuitry and methods could be implemented without substantial additional costs and would also be preferably retrofittable on or to previously installed systems.

DETAILED DESCRIPTION OF THE INVENTION

Figure 1:
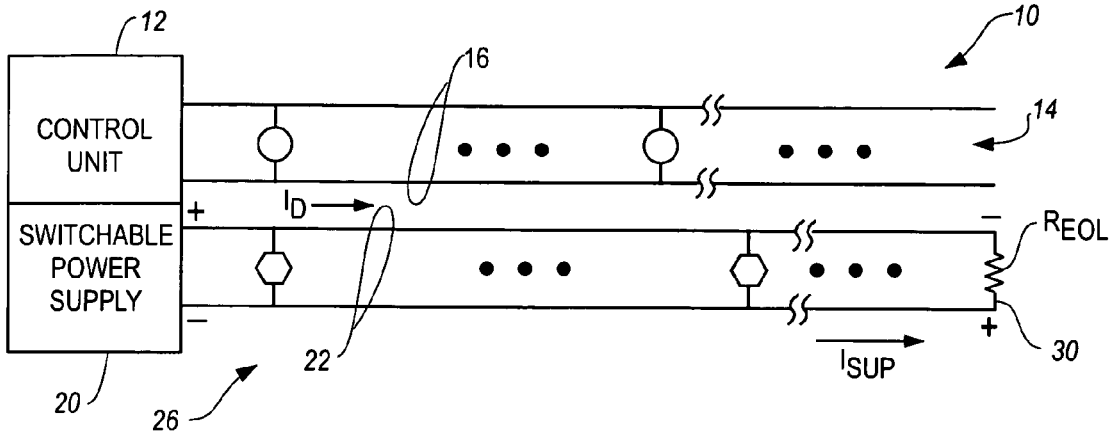
Fig. 1 PRIOR ART
FIG. 1 is a block diagram of a prior art alarm system.

While this invention is susceptible of embodiment in many different forms, there are shown in the drawing and will be described herein in detail specific embodiments thereof with the understanding that the present disclosure is to be considered as an exemplification of the principles of the invention and is not intended to limit the invention to the specific embodiments illustrated.

In one apparatus which embodies the invention, a non-linear or variable resistance element replaces the prior art resistor as the end of line element. For example, semiconductor diodes, thermistors, transistors or the like can be used as alternates to fixed or known resistors.

In one aspect of the invention, a non-linear element could be connected as an end of line device across the lines of a spur with a polarity such that a monitoring current can only flow therethrough when a switched power supply associated with the loop is in a non-alarmed, supervisory state. When the power supply switches to an active, alarm indicating state, the polarity is reversed and the non-linear element is open circuited. Further, as is known, the output devices, strobe lights, sounders and the like which are coupled across the spur all incorporate blocking diodes such that they cannot operate off of the monitoring current.

In another aspect of the invention, different magnitudes of monitoring currents can be coupled through the non-linear element. With such currents, the respective non-linear element appears to be exhibiting variable, higher or lower impedance values.

In a further aspect of the invention, the spur can be tested with a relatively low test current for purposes of detecting a parallel fault. Alternatively, the spur can be tested with a higher test current for purposes of detecting the presence of a series fault. The above-described methodology makes it more likely to be able to provide minimum operating current at the end of the spur in an alarm condition.

In another aspect, a method is provided for detecting open and short circuit conditions on alarm circuit wiring. It uses a non-linear device at the end of the circuit wiring to facilitate measurement of series and parallel faults. The non-linearity of the end of line (EOL) device allows accurate measurements to enable a fault warning to be given before the alarm devices attached to the wiring will fail to operate correctly. The present process is advantageous in that the known techniques using a fixed EOL resistor may not detect the early, 'partial fault', failure stages caused by high resistance connections or cable leakage until the problem is so severe that some or all alarm devices may fail to activate.

Figure 2:
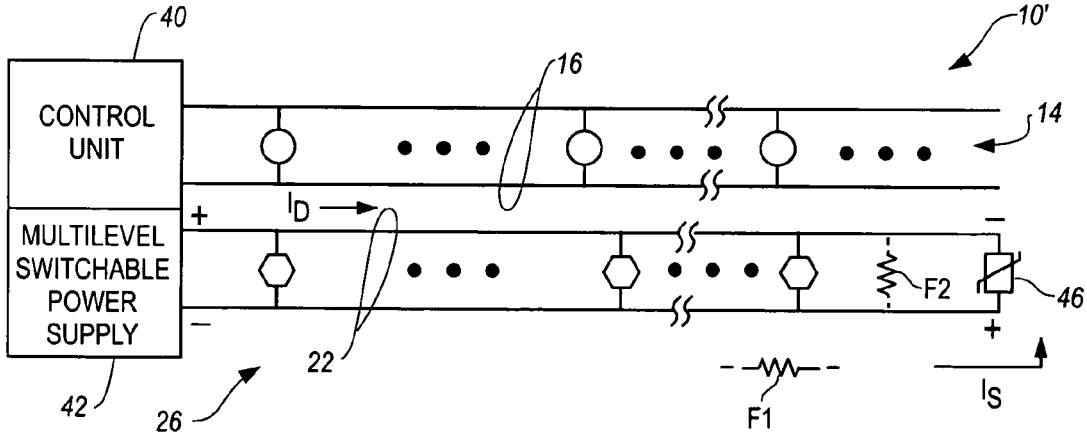
FIG. 2 is a block diagram of an alarm system in accordance with the present invention.

FIG. 2 illustrates an alarm system 10' in accordance with the invention. Elements of the system 10' which are the same as the elements of the system 10 have been designated with the same identification numerals as in the system 10. As such they need not be discussed further.

The system 10' incorporates a control unit 40, which as those of skill in the art will understand, could be implemented with one or more programmable processors and associated software. Control unit 40 is coupled to a multi-level switchable power supply 42 which can provide a drive current Id, with the indicated polarity, to provide electrical energy in an alarm condition to the output appliances such as audible or visible devices 26.

Normally the supply 42 reverse biases the output devices 26 when in a non-alarmed condition. In the event of an alarm condition the power supply 42 reverses polarity and energizes the output appliances via a drive current Id as indicated. In this condition, the spur 26 is not being supervised. The supply 42 can couple one or more different supervisory currents Is with the polarity indicated at a non-linear supervisory element 46 for purposes of supervising the condition of the wired medium 26.

The supervisory element 46 exhibits different impedance values, depending on the current therethrough as will be understood by those of skill in the art. Where the current value Is is relatively small the exhibited or apparent impedance associated with the supervisory element 46 is relatively large. Where the supervisory current Is is increased the apparent impedance of the supervising element 46 decreases due to the non linear characteristic thereof.

System 10' as illustrated in FIG. 2 can sense the presence of a series fault F1 or a parallel fault F2, both of which are indicated in phantom. Unlike the more limited sensing capabilities of the prior art system 10 of FIG. 1, relatively high resistance parallel faults F2, or partial short circuits, can be detected where supervisory current Is is relatively low. Where the supervisory current Is is greater, the supervisory element 46 has a relatively low effective impedance and can be used to detect faults such as F1, a relatively low resistance series fault. Thus, the faults in medium 26 can be detected before they are capable of affecting circuit operations.

Figure 3:
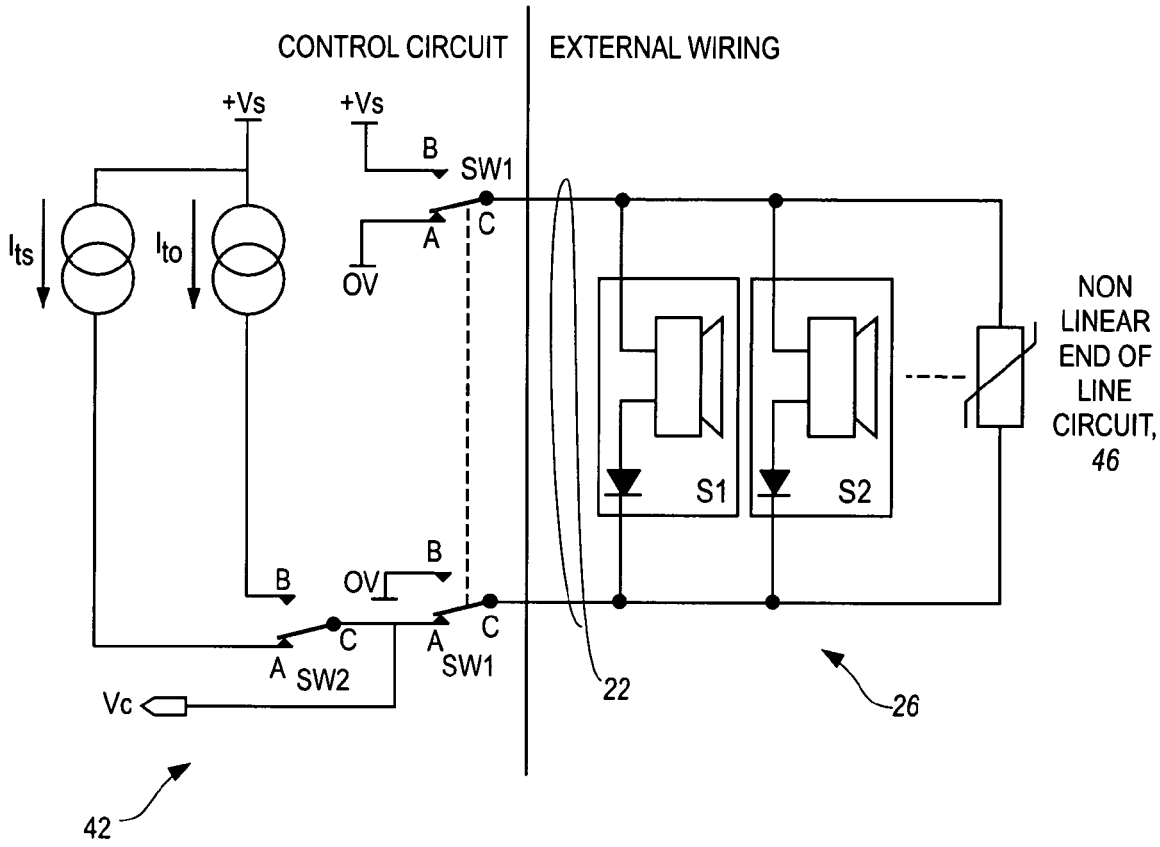
FIG. 3 is a partial block diagram of the system of FIG. 2 illustrating additional details thereof.

FIG. 3 illustrates added details of the monitoring circuit, in supply 42 and external wiring, or spur 22. In the alarm condition SW1 connects terminals B to C supplying the system supply voltage +Vs to the alarm devices 26 such as S1 and S2. The monitoring circuitry is not connected while in this condition. If monitoring while the alarm output is active is required, it is possible to temporarily switch to monitoring mode and back to alarm, provided there is adequate energy storage capacity in the alarm devices 26 for them to continue operating.

In the monitoring condition SW1 connects terminals A to C causing the alarm devices S1 and S2 to be reverse biased. The internal diodes in S1 and S2 ensure that the alarm devices will not operate as a result of the monitoring current. $I_{ts}$ and $I_{to}$ are current sources which can be implemented as would be understood by those of skill in the art.

$I_{ts}$ produces a low test current causing the element 46 to exhibit a high resistance. $I_{to}$ produces a higher test current causing the element 46 to exhibit a low resistance. These differing resistances can be used to improve the accuracy of the measurements and detect partial open and short circuits.

Figure 4A:
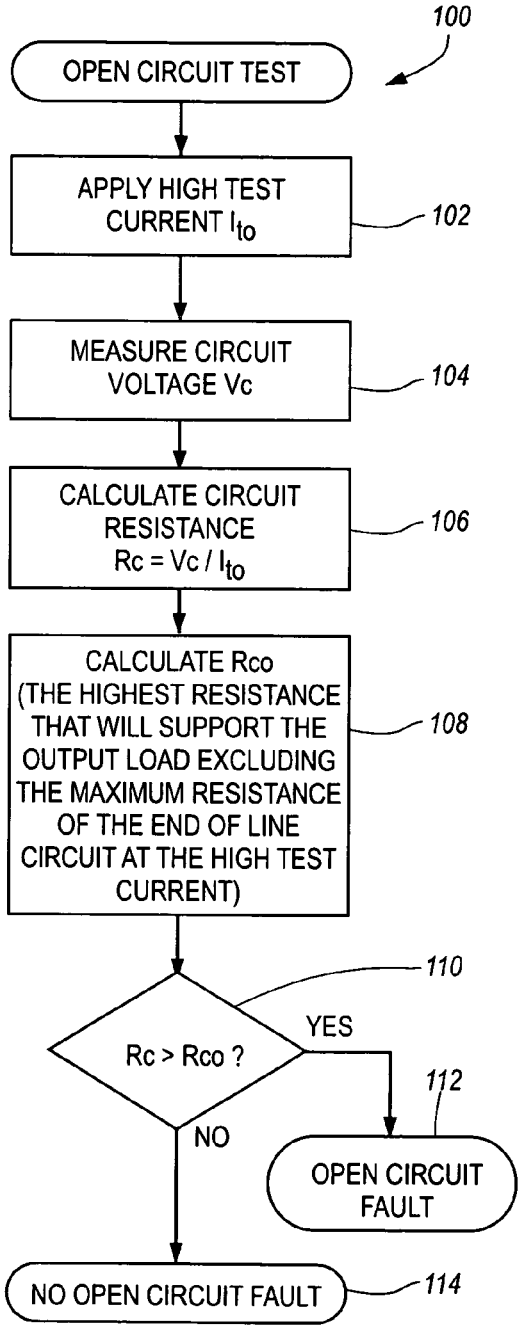
FIG. 4A is a flow diagram illustrating a method of conducting an open circuit test.

A monitored voltage value VC can be used to evaluate spur supervisory currents in various conditions. Supply 42 can then automatically provide fault indicating indicia to control element 40 if desired. The flow charts in FIGS. 4A, 4B illustrate the test sequences for determining both F1 series and F2 parallel faults.

Flow diagram 4A illustrates a method 100 for detecting the presence of open circuit F1-type faults. In a step 102 a relatively high test current Ito is coupled to the wiring 22 being supervised. In a step 104 a resultant voltage Vc is measured. In a step 106 a circuit resistance is determined. In a step 108 the highest resistance that will support the output load, excluding the resistance of the end of line circuit element at the high test current is determined.

In a step 110 the determined circuit resistance, step 106, is compared to the highest resistance, step 108. If the former is greater than the latter, an open circuit fault, F1-type has been detected, step 112. Otherwise, the condition of the wiring 22 is satisfactory, step 114.

Figure 4B:
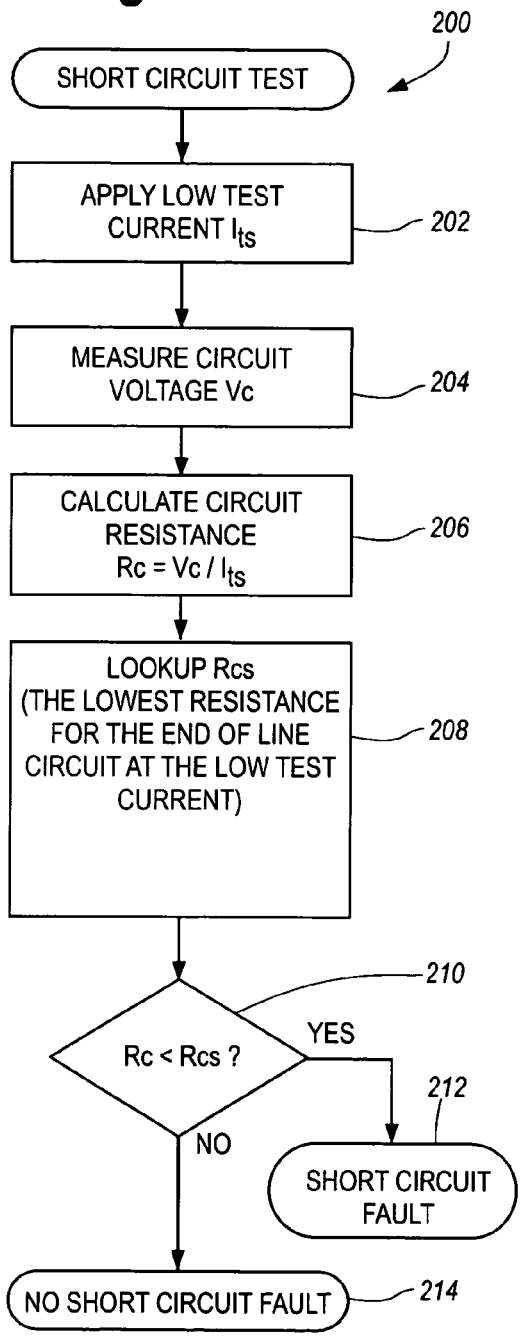
FIG. 4B is a flow diagram of a method of conducting a short circuit test.

FIG. 4B is a flow diagram of a method 200 of determining the presence of a parallel, type F2 fault. In a step 202 a lower test current is coupled to the wiring 22 and then is used in the open circuit test of method 100. In a step 204 a resultant voltage is measured. A circuit resistance value RC is determined in a step 206. In a step 208 the lowest resistance associated with the end of line element 46 at the low test current, step 202, is determined. It could, for example, be looked up manually or automatically. As would be understood by those of skill in the art, this reference value is pre-defined from the electrical characteristics of the device in use.

In a step 210 the determined circuit resistance, step 206, is compared to the value obtained, step 208. If the determined circuit resistance from 206 is less than the obtained value, step 208, a short circuit fault, F2 type, has been detected and an appropriate condition indicating indicium can be generated indicative thereof. Otherwise, the spur 22 is exhibiting acceptable characteristics, step 214.

The order of carrying out methods 100, 200 can be interchanged without departing from the spirit and scope of the invention. Also, it is within the scope of the invention to evaluate the existence of only one type of fault.

Figure 5A:
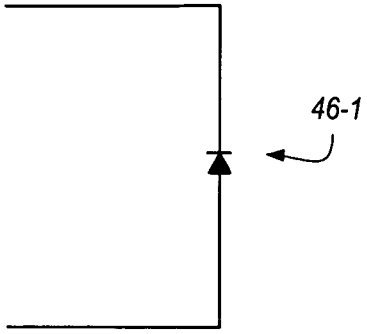
FIGS. 5A through 5D illustrate alternative embodiments of a non-linear end-of-line element usable with the system of FIG. 2.

The element 46 can be implemented in many different ways. FIGS. 5A-5D illustrate four alternatives. Other alternatives come within the spirit and scope of the invention. In FIG. 5A the forward characteristics of a diode are used to produce a nominally constant voltage with varying current.

Figure 5B:
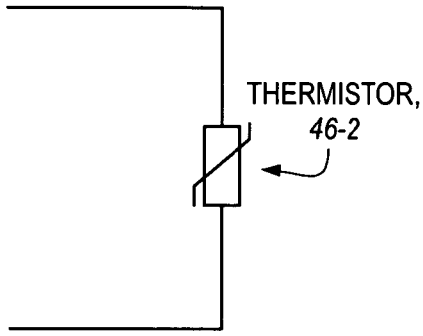

FIG. 5B uses the self heating properties of a thermistor to reduce the device resistance at higher currents.

Figure 5C:
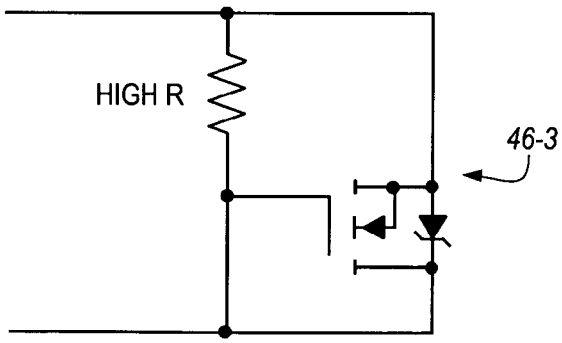

In FIG. 5C the current through a resistor turns the MOSFET on when the gate voltage reaches the turn-on threshold. This allows the effective resistance of the circuit to be selected by adjusting the test current and resistor value.

Figure 5D:
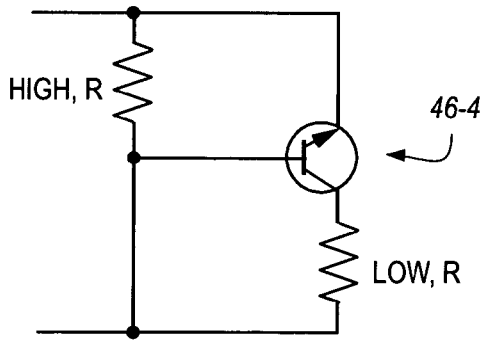

In FIG. 5D a similar scheme to FIG. 5C is used. However, the addition of an extra resistor allows further control of the effective resistance.

Those of skill will understand that it is necessary to protect the element 46 from over voltage and current during an alarm condition where the output devices 26 are activated. With most of the solutions this will require additional components. However, the diode in FIG. 5A combines both non-linear forward and reverse protection in a single component, and is a preferred embodiment of a non-linear end-of-line element 46.

Figure 6:
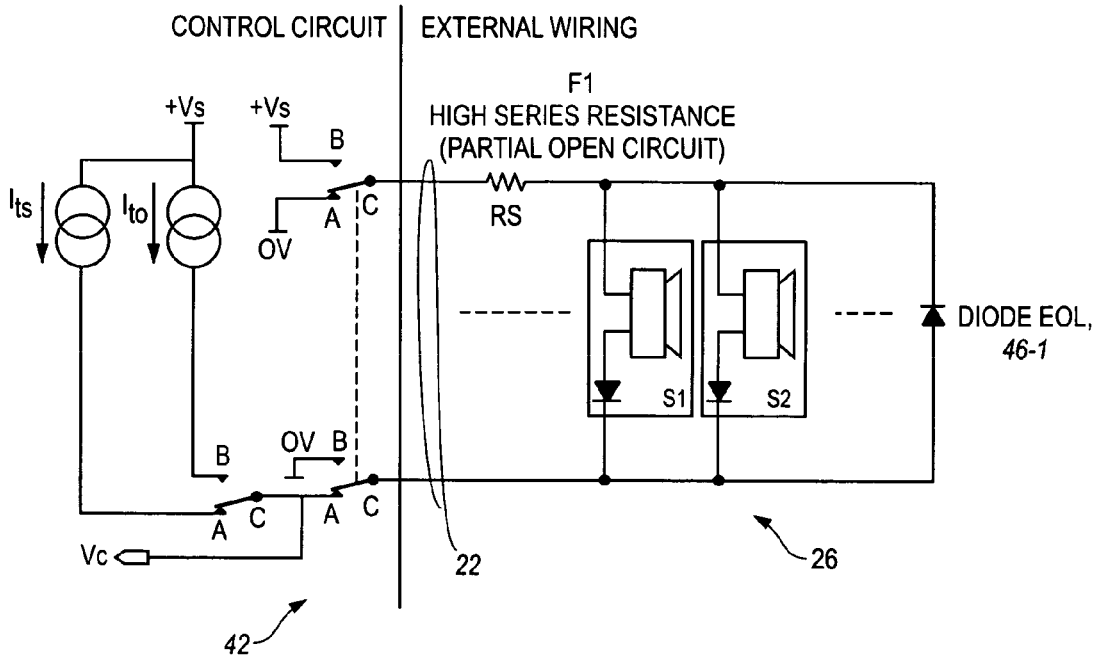
FIG. 6 illustrates the system of FIG. 2 with a series resistance-type fault ('partial open circuit')

In FIG. 6 a series fault F1 is illustrated in spur 22. When monitoring the spur 22 it is necessary to detect any series resistance that is high enough to interfere with or to stop the output devices S1 and S2 from operating, but not to report a fault for the expected cable resistance.

This condition can be detected using process 100 and the following exemplary values:

For supply voltage 24V: Load current 1 A: Minimum device operating voltage 15V

The maximum circuit resistance guaranteed to operate the sounders is: (24−15)/1=9 ohms.

For test Current ($I_{to}$) 100 mA: Forward voltage of diode at 100 mA: 0.7V The effective resistance of the diode at 100 mA is: 0.7/0.1=7 ohms.

So with a 100 mA test current the monitoring voltage Vc should not exceed: 0.1×(9+7)=16 volts.

In addition the variability of the device parameters and distribution of the load must be taken into account. This can be provided for by adjusting the maximum pass limit.

Figure 7:
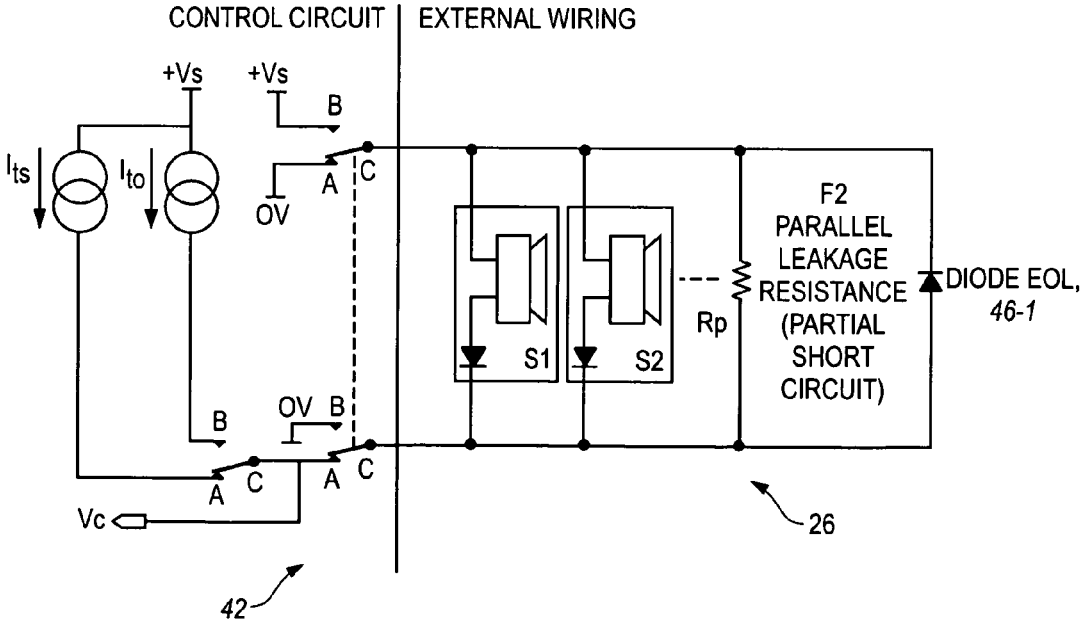
FIG. 7 illustrates the system of FIG. 2 with a parallel resistance-type fault ('partial short circuit').

In FIG. 7 a parallel short-circuit fault F2 is illustrated in spur 22. In this case, it is necessary to detect a parallel resistance before the current is so great that the combination of the load current and fault current causes the output current limit to activate, thereby causing the loss of all alarm devices. The test current $I_{ts}$ is passed through the diode 46-1 and the parallel short Rp. From the voltage detected at Vc the value of Rp can be calculated. If this value is too low, then the presence of the fault can be detected and remedial steps can be taken.

The F2-type fault can be detected using the process 200 and the following exemplary values:

For maximum load current 1 A: Output current limit 1.1 A: Supply voltage 24V

The maximum supported parallel leakage resistance is: 24/(1.1−1)=240 ohms

For $I_{ts}$=1 mA: Forward voltage of diode @ 1 mA=0.6V

The nominal circuit voltage should be 0.6V

With 240 ohms parallel resistance virtually all the test current will flow through the parallel short giving a circuit voltage of 0.24V. Therefore, if the circuit voltage Vc is less than 0.24V operation of the alarm devices cannot be guaranteed. Again the variability of components must be taken into account; the actual threshold used will need to be adjusted to compensate therefore as would be known to those of skill in the art.

While the element 46 has been illustrated at an end-of-line location, it will be understood that the invention is not so limited. Other locations of non-linear element 46 come within the spirit and scope of the invention. It will also be understood that the invention can be incorporated into other cable configurations without departing from the spirit and scope thereof. For example, in accordance with the invention, non-linear elements could be incorporated in and used to evaluate fault conditions in looped cable configurations.

From the foregoing, it will be observed that numerous variations and modifications may be effected without departing from the spirit and scope of the invention. It is to be understood that no limitation with respect to the specific apparatus illustrated herein is intended or should be inferred. It is, of course, intended to cover by the appended claims all such modifications as fall within the scope of the claims.

The invention claimed is:

1. A system comprising:

an electrical network having at least first and second conductors where the conductors are terminated by a variable impedance, electrically alterable, element;

a first current source that produces a first relatively low supervisory test current through the first and second conductors and variable impedance element;

a first processor that determines a circuit resistance to the first test current through the first and second conductors and variable impedance element and that detects a short circuit fault type when the determined circuit resistance is less than a predetermined value;

a second current source that produces a second supervisory test current through the first and second conductors and the variable impedance element where the second test current has a higher relative magnitude than the first test current and where the first and second test currents are applied at different times; and a second processor that determines a circuit resistance to the second test current through the first and second conductors and variable impedance element and that detects an open circuit fault type when the determined circuit resistance is greater than a predetermined value.

2. A system as in claim 1 which includes a plurality of electrical devices, the members of the plurality are each coupled to the conductors.

3. A system as in claim 2 where the electrical devices are selected from a class which includes at least visual output devices and audible output devices.

4. A system as in claim 2 which includes a switchable power supply.

5. A system as in claim 4 where the power supply exhibits a first output polarity and a second reverse polarity.

6. A system as in claim 5 where the power supply couples electrical energy to the members of the plurality when exhibiting the first output polarity.

7. A system as in claim 6 where the power supply couples the first supervisory current or the second, different supervisory current to the conductors when exhibiting the second polarity.

8. A system as in claim 7 where the impedance of the element varies in response to the magnitude of the coupled supervisory current.

9. A system as in claim 8 where the first supervisory current allows the detection of high resistance parallel faults in the conductors.

10. A system as in claim 9 where a lower second supervisory current allows the detection of low resistance series faults in the conductors.

11. A system comprising:

a multi-conductor cable having at least first and second conductors;

a variable impedance element coupled to the cable to terminate the conductors;

circuitry that couples first and second, different supervisory currents to the cable through the conductors and the variable impedance element at different times in evaluation of the presence of first and second different types of faults; and a processor that detects the first and second faults based upon the resistance produced by the respective first and second supervisory currents.

12. A system as in claim 11 which includes circuitry that evaluates the results of coupling the two supervisory currents to the cable.

13. A system as in claim 11 where the cable has first and second ends with the element coupled thereto at one of an end, or, between the ends.

14. A system as in claim 13 where the element incorporates one of a semiconductor diode, a heat responsive semiconductor component, a radiant energy responsive component, or a plurality of fixed resistors to provide the variable impedance.

* * * * *